United States Patent [19]

Spencer

[11] 4,154,254

[45] May 15, 1979

[54] AUTOMOBILE PROTECTOR

[76] Inventor: William Spencer, 3759 Third Ave., Los Angeles, Calif. 90018

[21] Appl. No.: 866,694

[22] Filed: Jan. 3, 1978

[51] Int. Cl.[2] ..... A45F 1/16

[52] U.S. Cl. ..... 135/4 A; 135/2; 150/52 K; 296/136

[58] Field of Search ..... 296/136; 150/52 K; 135/4 A, 2, 15 CF

[56] References Cited

U.S. PATENT DOCUMENTS

| | | | |
|---|---|---|---|
| 1,751,518 | 3/1930 | MacLean | 135/4 A |
| 1,999,171 | 4/1935 | Bryant | 150/52 K |
| 2,508,757 | 5/1950 | Gray | 150/52 K |
| 2,571,362 | 10/1951 | Hervey | 296/136 |

FOREIGN PATENT DOCUMENTS

| | | | |
|---|---|---|---|
| 718958 | 11/1966 | Italy | 135/4 A |

*Primary Examiner*—Benjamin W. Wyche
*Assistant Examiner*—Conrad L. Berman

[57] ABSTRACT

A cover which may be removably installed over a vehicle including a shroud mounted on an umbrella-like frame which fits in close relationship to a vehicle to be covered. The frame may include a plurality of supports or ribs extending outwardly from a central hub and downwardly so as to generally encompass a vehicle which may be covered. An extensible means may be provided to join some or all of the support ribs about the lower ends thereof in order to firmly hold the cover in place. An articulated lever-like handle may be mounted on the hub. The lever may be locked so that its sections are in linear relationship, thereby facilitating lifting one cover over a car during installation or removal. A slidable latch is illustrated for locking the lever in its linear configuration. A spring biases the articulated sections of the lever into the linear relationship. When the cover is in place and it is desired to prohibit removal, the sections of the lever may be moved relative to one another and the outer end thereof locked to the lower end of one of the support ribs.

4 Claims, 4 Drawing Figures

AUTOMOBILE PROTECTOR

Figure 1:
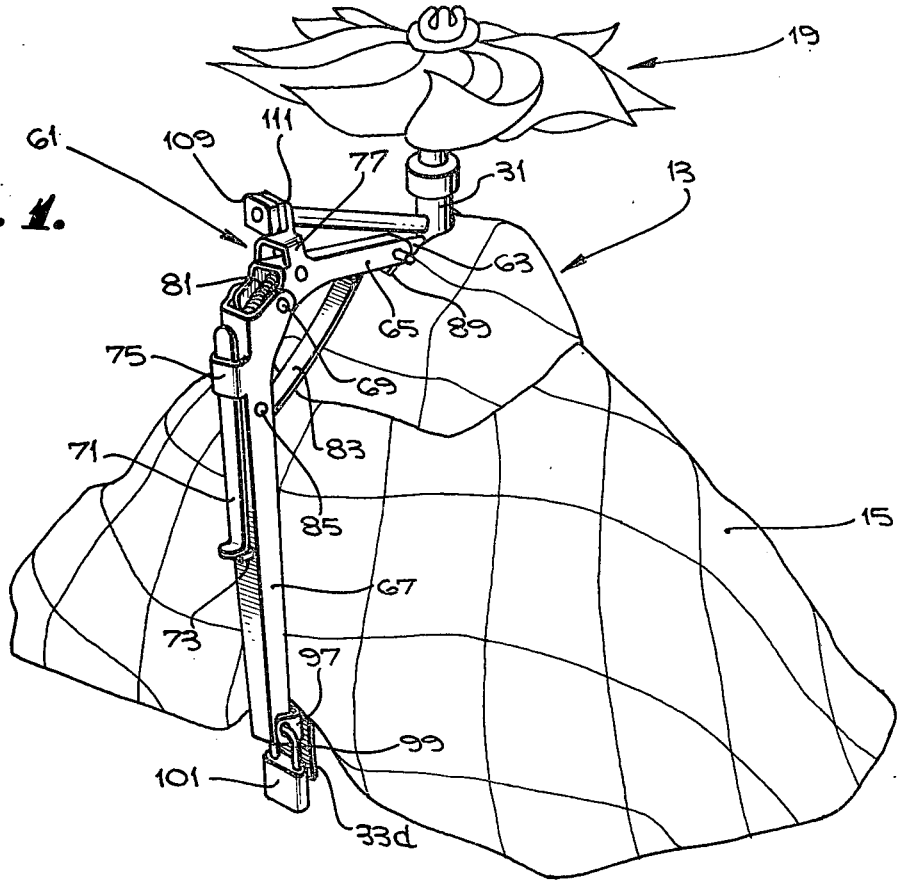

The present invention relates to a structural cover which may be quickly and simply installed over or removed from an object which is to be protected, for example, an automobile. In the past, two types of covers have been primarily considered, although only one of the types has apparently achieved commerical acceptance in the market place. That type which is most readily available today generally comprises a tarpaulin or shroud which may, if desired, be produced so as to essentially "form fit" the automobile upon which it is to be installed. In fact, when such covers are available, they are normally produced so as to fit closely over small foreign cars. Since such soft, flexible covers are generally difficult to manage, it is believed that the relative unavailability of these covers is due to the fact that they must be dragged across the surface of an automobile during installation and removable. In other words, if such a cover were to be used with a full size car, it would have to be placed on the car and, to a large extent, dragged across the car's surface in order to position it. This is damaging to the car's surface since pollutants on the surface of the metal, some of which may cling to the inner surface of the cover, can cause microscopic scratching of the surface resulting in eventual deterioration. An example of the disclosure of such a cover has been shown in U.S. Pat. No. 2,620,007 to Keller.

Since the soft covers are fairly bulky and limp, they are difficult to handle except in the case of the very smallest automobiles. It is for this reason that most such covers are utilized with small, usually imported, sports cars. It is true, of course, that some lightweight materials are now being employed with larger cars, but the danger of scratching the car's finish is greatly increased when the cover has to be dragged across any part of the car.

On the other hand, a wide variety of covers or canopies have been disclosed which use a framework which may be mounted on the car or the ground above the car. Thus, the soft cover can be drawn over the framework in a manner such that its contact with the surface of the car is minimized. Such devices are shown, for example, in U.S. Pat. Nos. 2,571,362 to Hervey, 3,316,012 to Thier, and 3,785,697 to Dabbs. In each of these disclosures, a frame is provided which may be temporarily installed on the vehicle. The user then takes a canopy or cover, positions it at one end of the vehicle, and then draws it across the frame in order to semi-enclose the car and protect it from the elements. Unfortunately, in each case the entire structure is quite bulky and cumbersome, requiring a relatively large length of time to install or remove the cover. Further, the soft material of the cover is relatively bulky and difficult to handle, thus reducing the possibility that the car owner will install the cover on regular basis.

Finally, there are some covers having a frame to which a soft shroud may be fixed for simultaneous removal or installation basis. Such a cover has been shown, for example, in U.S. Pat. No. 2,992,649 to Swallow. While covers of this type eliminate much of the surface-to-surface contact between the automobile and the soft material, they are relatively cumbersome and are difficult to move from place to place. In fact, it is often necessary to place such a cover into position on the ground and then drive the car into position, subsequently moving the cover over the car.

Thus, all of the prior art covers are deficient insofar as they cause a great deal of surface-to-surface contact and relative movement between the cover and the car, require a relatively great length of time to install or remove, and/or are relatively cumbersome and difficult to locate relative to a stationary automobile. Consequently, none of the prior art devices solved the problem of providing a highly mobile cover which can be installed over or removed from a vehicle in a very short period of time, while minimizing rubbing contact between the cover and the vehicle.

The present invention relates to such a structure which the vehicle owner can quickly and easily lift in order to install it over the vehicle or remove it. Basically, a device formed in accordance with the present invention may include an umbrella-like frame having a plurality of ribs which extend outwardly and downwardly from a central hub. Thus, when the frame is positioned over the vehicle, the ribs or supports will extend from the hub which can be located on top of the vehicle, to positions close to the ground. To these ribs, a suitable soft material or shroud may be attached on a semi-permanent basis for protection of the vehicle or other structure being covered. If desired, the lower ends of some or all of the ribs may be interconnected by an extensible element which aids in holding the lower ends of the ribs in position, even in windy conditions.

In order to facilitate installation and removal of the cover, a handle may be fixedly attached to the central hub in such a way that when the owner lifts the canopy or cover, the weight of the cover and the forces exerted by his hands cause the handle to act in a manner of a first class lever. Thus, by placing one hand near the mid-length of the lever, and the other hand near the lever end distal from the hub, the owner can pull down with the hand at the distal end and push up with the hand near the center of the lever, thus lifting the cover easily. When he does this, he can position the cover in any desired location. Of course, it is preferable that the cover be constructed in such a way as to make it extremely difficult for thieves or vandals to remove the cover or damage it. Accordingly, it is presently envisioned that the handle or lever be formed with an articulation joint near the midpoint thereof. Thus, when the handle is not being used, the outer section of the handle, i.e., that part not attached directly to the central hub, can be moved to a substantially vertical position in which it cannot be used as a lever. To prevent unauthorized persons from moving the handle section back to the linear relationship of its lever configuration, suitable means may be provided to lock the outer end of the handle to one of the rib supports of the canopy. Thus, the handle cannot be used to move the cover until such time as the lock is removed.

In order to prevent injury to the operator or damage to the object being covered, it is presently envisioned that the handle may be provided with a biasing means, such as a spring, which tends to force the outer section of the handle into a linear relationship with the inner section. Further, if desired, a latching device may be provided to temporarily lock the handle in the linear relationship.

In order to facilitate removal of the cover, a draw string type system may be provided on the frame for moving that portion of the frame on the far side of the hub from the handle radially outwardly. This will aid the user in preventing scratching of the car when the cover is moved.

The extensible element connecting the lower ends of the ribs may be provided with suitable fastening means which may be selectively released when the cover is removed. Also, if desired, suitable ornamental structures may be applied to the cover for decorative purposes.

Upon reviewing the following detailed description, taken together with the drawings, those skilled in the art will quickly realize that the present invention may be embodied in a wide variety of structures, only one of which has been described and depicted here. Other such structures may fall within the purview of the appended claims without departing from the spirit of the invention.

The accompanying drawings are submitted for the purposes of further illustrating the invention and the best contemplated mode thereof, and not for the purposes of limiting the invention.

Figure 2:
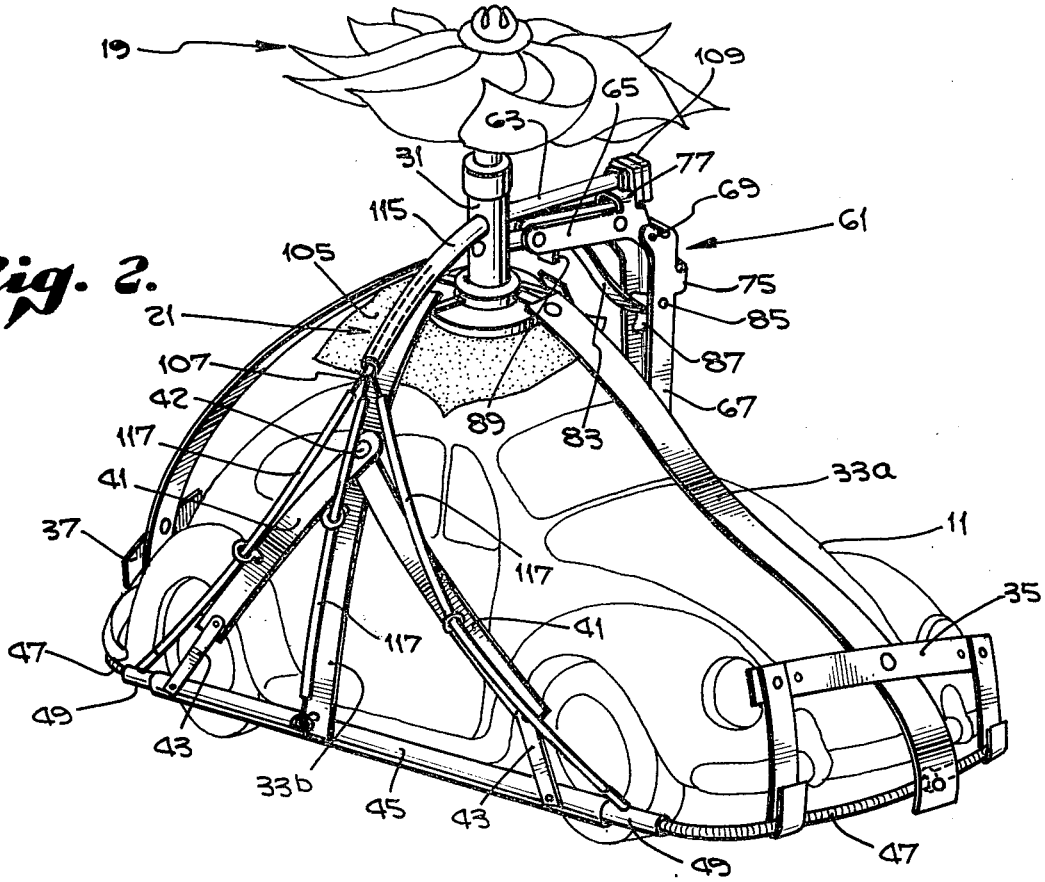
Figure 3:
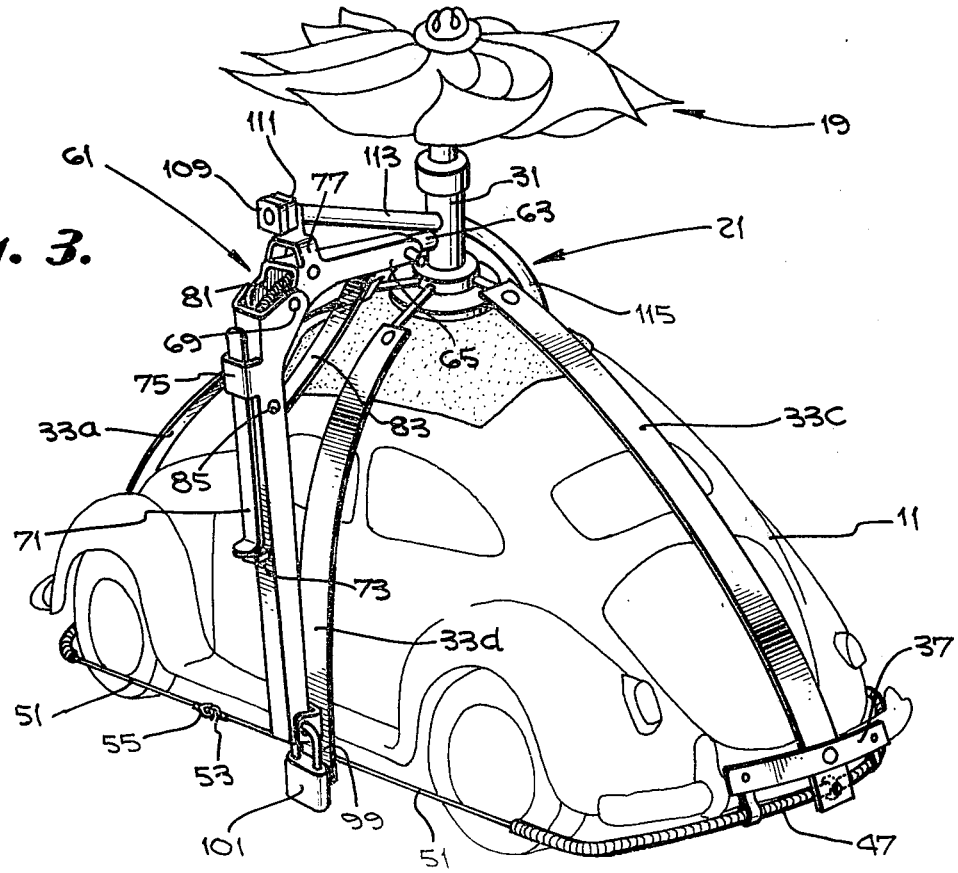

In the drawings, there is illustrated:

FIG. 1 comprises an isometric view of a cover placed over a car and locked in position to prevent unauthorized removal—the view depicted might, for example, be considered to be looking at the car with the left rear fender nearest to the viewer;

FIG. 2 comprises a view similar to FIG. 1, with the shroud removed, taken from a location about the car approximately 180 degrees relative to that shown in FIG. 1;

FIG. 3 comprises a view similar to FIG. 1 with the shroud removed; and

Figure 4:
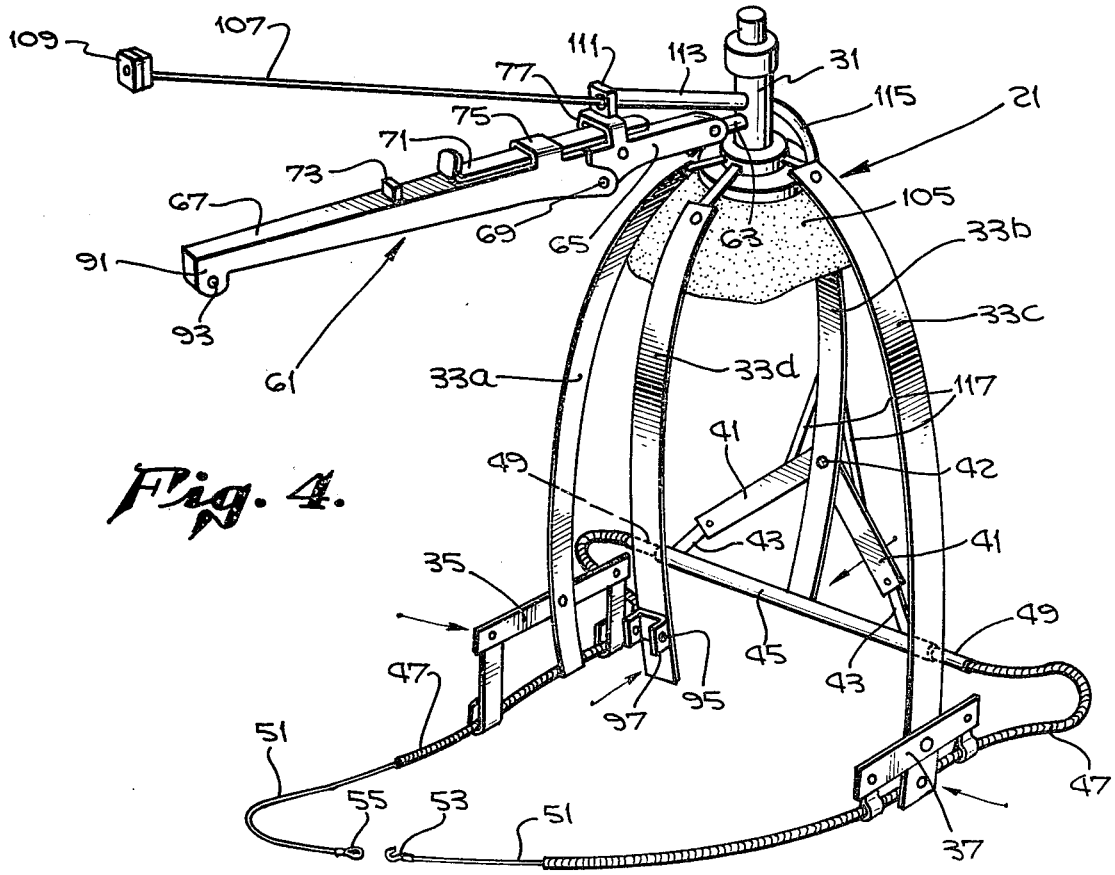

FIG. 4 comprises a view of the frame of a cover formed in accordance with the present invention.

Referring to the four figures of the drawing together, it can be seen in FIGS. 2 and 3 that an automobile 11 may be provided with a temporary covering generally designated 13. This covering may, if desired, include one or more shroud sections 15 and 17 which prevent moisture, chemicals, etc., from falling and settling on the car. Also, if desired, an ornamental device 19 which might, for example, resemble a plastic pin wheel, may be mounted on the upper portion of the cover.

As shown in FIGS. 2–4, the cover 13 may include a frame 21 which may be positioned on the vehicle and to which the shroud sections 15 and 17 may be attached in any suitable manner.

Frame 21 may be of any suitable design configuration, preferably depending upon the particular shape of the car which is to be covered. For example, the car illustrated in the drawings requires a rather simple frame which will support the shroud sections 15 and 17 in such a manner that they do not have to be dragged across the car surface. In other words, the frame is relatively light in weight so that, in company with the shroud sections 15 and 17, it can be easily lifted over and removed form the car. Preferably, the frame may include a central hub 31 to which a plurality of lightweight, somewhat flexible, supporting ribs 33*a*–33*d* may be removably attached. Thus, each of the ribs 33 may be suspended from the central hub 31 in a manner generally resembling an umbrella. Of course, while only four such ribs are illustrated, any desired number may be provided to provide desired strengths, etc.

Each or any of the ribs 33 may be provided with suitable structure for supporting the rib on a car to be covered and minimizing bearing pressure between the rib and the car. For example, as shown in FIGS. 2 and 4, rib 33*a* may be provided with a bearing section 35 of any suitable configuration which can rest against the bumper, grill, etc., of the car and distribute the weight of the cover in that location although a larger area, thus minimizing the possibility of any weight damage which might occur to the car in that location. Similarly, rib 33*c* may be provided with a bearing or support 37 which can rest against the back bumper of the car for the same purpose.

As shown particularly in FIGS. 2 and 3, rib 33*b* may, if desired, be provided with supplemental rib sections 41 connected to rib 33*b* by any suitable means such as a pin 42. If desired, the rib sections may also include lower support sections 43. In this exemplary embodiment, there is shown attached to the lower end of rib 33*b* a horizontal support section 45 into which flexible tubular elements 47 may be fixed by any suitable means, such as extension sections 49. The sections 49 may, in turn, be suitably fixed within the horizontal support 45 in any desired manner. Extending through the tubes 47 from the locations of extentions 49, may be a pair of extensible elements 51, one including a hook section 53 and the other an eyelet section 55. The hook 53 may be threaded through the eyelet 55 to temporarily join the sections 51 into a single unit. As illustrated, when the hook and eyelet are threaded together, the lower end of the frame 21 will be maintained in the position illustrated in FIG. 3, i.e., closely aligned with the car.

A handle or lever 61 may be fixedly attached to the hub 31 at one end thereof by any suitable means, such as a pin 63. Preferably, the handle 61 may comprise a first section 65 and a second or outer section 67. These sections may be pivotably connected to one another by any suitable means such as a hinge screw 69, thus allowing the handle to be articulated between the positions illustrated in FIGS. 1 and 4, when desired. A slidable locking bar 71 may be mounted on the second section 67 of the handle for movement between the position shown in FIG. 1, in which it is resting against a stop 73 and is captured by a slide element 75, and that of FIG. 4 in which the leading end thereof is captured within a receiver 77 on the first handle portion 65. Thus, when the slide element 71 is moved to the position shown in FIG. 4, the cooperation of the slide section 75 and the keeper 77 will be such that it will be impossible to cause relative movement of the handle sections about the pin 69.

If desired, a coil or other type of spring 81 may be provided within the handle to bias the handle sections relative to one another toward the position shown in FIG. 1. Also, if desired, an articulation stop element 83 may be pivotally mounted on a pin 85 in the second handle section 67 and slidably received within the first handle section 65. A flat biasing spring 87 may be provided, as shown in FIG. 2, to urge the stop element 83 against the undersurface of the handle section 65. Thus, as the handle is articulated to the nonlinear position illustrated in FIG. 2, the free end of the element 83 will eventually contact a stop 89 fixed in the undersufrace of the handle section 65, thus limiting the relative movement. If desired, the outer or free end of the handle section 67 may be provided with a flange section 91 including a bore 93. When the handle is articulated, the bore 93 may be aligned with a similar bore 95 formed within a receiving flange 97 in the lower end of rib 33*d*. Thus, when the handle is articulated into its nonlinear configuration, the alignment of the bores 93 and 95 may be accomplished so as to install the shackle 99 of a padlock 101 therethrough in order to lock the handle 61 in that position.

In utilizing the cover 13 described thus far, it will be apparent to those skilled in the art that, when the cover is to be installed, the handle 61 may be placed in the linear configuration shown in FIG. 4 and the slide lever 71 actuated to lock the handle against articulation. Thus, the handle 61 will act as a lever and the operator may pull down on the outer hand of the handle while pushing up near the center thereof, thus accomplishing an easy and smooth lifting of the cover frame 21 and its attached shroud sections. When the frame 21 is lowered onto the car to be covered, contact between the central hub 31 and the top of the car may be eliminated, if desired, by attaching a relatively small cushion 105 to the undersurface of the hub. Thus, the cushion will rest against the surface of the car but the hub will never touch it.

In some cases, it is quite difficult to lift the frame off of a car in such a manner that no part of the frame or the rib contacts and scratches or otherwise damages the car's surface. Consequently, a plurality of lines or cords 107 may be provided to extend between a pulling handle 109 which may be normally seated against a flange 111 on or near the slide keeper 77 as illustrated in FIG. 4. The lines 107, which may be extensible, if desired, may then be passed through a first tube 113, a second tube 115, and then through a plurality of tubes 117, as illustrated in FIG. 2. Thus, when the operator unthreads the hook 53 on eyelet 55, he may pull on the handle 109, moving the horizontal support element 45 upwardly and outwardly from the car even before he begins to lift on the handle 61. As a result, when he pulls on the handle 109, the horizontal support 45 and, to some extent, the support frames 35 and 37, will move toward the opposite side of the car from that upon which he is standing. Then, when he uses the handle as a lever to lift the frame, those portions thereof on the opposite side of the car from the operator will be steadily maintained away from the car so that they cannot contact it and scratch or otherwise damage it. Of course, it is expected that the operator may also desire to accomplish this similar movement of the frame as he is lowering the cover over the body of the car. Since the rib **33*d* nearest the operator during installation or removal of the cover is not attached to the flexible elements 51, it will not move when the operator pulls on the handle 109. Rather, rib 33*d* will tend to swing outwardly toward the operator as he uses the handle as a lever to lift the frame, thereby also preventing the rib 33*d*** from contacting the car.

In summary, when one wishes to use the cover of the present invention, he must first ensure that the hook 53 and eyelet 55 are separated and that the handle 61 is in the linear condition shown in FIG. 4. He can then grasp the handle 109 and pull the cords 107, thereby pulling the frame away from the opposite side of the hub from that upon which he is standing. He may then actuate the handle 67 in the manner of a lever, using his two hands with the one closer to the hub acting as a fulcrum, and place the entire cover over the vehicle. Next, he can thread the hook 53 into the eyelet 55, move the slide element 71 away from the keeper 77, articulate the handle to the position shown in FIGS. 1 and 3, and install the padlock as illustrated. In this manner, he will prevent unauthorized removal of the cover and move the handle to a position in which it will not interfere with a neighboring vehicle. If desired, of course, he could also form the extensible elements 51 in such a manner that they also would be locked in the shackle 99 of the padlock 101. This might be accomplished, for example, by providing each of the elements 51 with an eyelet, such as that shown in 55, which could be placed over the shackle.

Having now reviewed the above detailed description of the invention, those skilled in the art will realize that a wide variety of embodiments utilizing this invention may be produced without deviating from the scope of the invention as defined in the following claims, even though they may not physically resemble the exemplary embodiment.

What is claimed is:

1. Apparatus for removably supporting an automobile protective cover comprising a frame including a central hub member, a plurality of support members movably and flexibly dependent from said hub member, means interconnecting at least some of support members adjacent the ends thereof distal from said hub member, and lifting handle means mounted on said hub member and having a first section, a second section, means pivotally connecting said first and second sections to one another, biasing means for urging said first and second sections into a linear relationship about said pivotal connecting means, means for selectively locking said first and second sections to one another to form a lever for raising and lowering said frame over an automobile to be covered, and means for selectively fixing one of said first and second sections distal from said pivotal connecting means to one of said support members to prevent use of said handle means for raising or lowering said frame.

2. The apparatus of claim 1 including a plurality of cable means, each attached to said interconnecting means at intermediate locations therealong and means on said handle means for supporting the unattached ends of said cable means for grasping by an operator for selectively moving a portion of said frame distal from said handle away from the object to be covered.

3. An umbrella-like cover for protecting a structural element comprising a frame having a central hub member, a plurality of support ribs movably fastened to said central hub and extending outwardly therefrom in substantially equiangular relationships about said hub member, extensible means, interconnecting at least two of said support ribs near the ends thereof distal from said hub and sized so as to extend about the structural element which is to be protected, for fixing said frame to the structural element, means for selectively outwardly moving at least one of said support ribs to facilitate placement and removal of said frame over a structural element to be protected, articulated lever means fixed to said frame for facilitating movement of said frame over and away from an element to be protected, and shroud means fixed to said support ribs for protection of a structural element over which said frame is placed.

4. The cover of claim 3 wherein said lever means includes means for biasing said lever means such that the articulated portions thereof are in linear relationship, means, selectively actuatable, for locking said lever means in such linear relationship, and means adjacent one end of said lever means and cooperable with at least one of said support ribs for facilitating locking of said lever means such that the articulated portions thereof are in a nonlinear relationship.

* * * * *